US007387538B2

(12) United States Patent
Engel et al.

(10) Patent No.: US 7,387,538 B2
(45) Date of Patent: Jun. 17, 2008

(54) CONNECTOR STRUCTURE FOR A TRANSCEIVER MODULE

(75) Inventors: Andy Engel, Portola Valley, CA (US); Gary D. Sasser, San Jose, CA (US); Chris Togami, San Jose, CA (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 11/689,403

(22) Filed: Mar. 21, 2007

(65) Prior Publication Data

US 2007/0224884 A1 Sep. 27, 2007

Related U.S. Application Data

(60) Provisional application No. 60/785,162, filed on Mar. 23, 2006.

(51) Int. Cl.
*H01R 13/66* (2006.01)

(52) U.S. Cl. ..... 439/620.23

(58) Field of Classification Search ..... 439/620.05, 439/620.06, 620.11, 620.12, 620.15, 620.17, 439/620.18, 620.19, 620.23
See application file for complete search history.

(56) References Cited

U.S. PATENT DOCUMENTS 5,321,372 A 6/1994 Smith
6,102,741 A * 8/2000 Boutros et al. ..... 439/620.06
6,335,869 B1 1/2002 Branch et al.
6,439,918 B1 8/2002 Togami et al.
6,459,517 B1 10/2002 Duncan et al.
6,533,603 B1 3/2003 Togami
6,705,879 B2 * 3/2004 Engel et al. ..... 439/76.1
6,731,510 B1 * 5/2004 Hwang et al. ..... 361/754
6,758,699 B1 * 7/2004 Hwang et al. ..... 439/676
6,786,653 B1 * 9/2004 Hwang et al. ..... 385/92
6,817,782 B2 11/2004 Togami et al.
6,848,943 B2 * 2/2005 Machado et al. ..... 439/607
6,872,094 B1 * 3/2005 Murr et al. ..... 439/607
6,876,838 B1 * 4/2005 Daly et al. ..... 455/90.3
6,953,289 B2 10/2005 Togami et al.

(Continued)

OTHER PUBLICATIONS

Small Form-factor Pluggable (SFP) Transceiver Multisource Agreemenet (MSA), Cooperation Agreement for Small-Form-factor Pluggable Transceivers, Agilent Technologies, et al., Sep. 14, 2000.

(Continued)

*Primary Examiner*—Ross N Gushi
(74) *Attorney, Agent, or Firm*—Workman Nydegger

(57) ABSTRACT

A transceiver module, such as a copper transceiver module, that utilizes an example connector structure for receiving the plug of a communication cable. The example connector structure is configured to house a plurality of electronic components in such a way as to efficiently utilize the space within the connector structure itself. In one example embodiment, a connector structure for use in a copper transceiver module includes a body, a first plurality of conductive elements attached to the body, and first and second cavities defined in the body. The first plurality of conductive elements is configured to electrically connect with a corresponding second plurality of electrical elements on a plug of a communications cable. A first plurality of electrical cores and a printed circuit board are positioned in the first cavity. A second plurality of electrical cores is positioned in the second cavity.

20 Claims, 4 Drawing Sheets

U.S. PATENT DOCUMENTS

| | | | | |
|---|---|---|---|---|
| 7,153,163 | B2 * | 12/2006 | Lewis et al. | 439/620.11 |
| 7,181,173 | B1 * | 2/2007 | Daly et al. | 455/90.3 |
| 7,314,384 | B2 * | 1/2008 | Togami et al. | 439/484 |
| 7,326,084 | B1 * | 2/2008 | Chen et al. | 439/620.23 |
| 2002/0086584 | A1 * | 7/2002 | Liu | 439/620 |
| 2002/0155758 | A1 * | 10/2002 | Wang | 439/620 |
| 2003/0228799 | A1 * | 12/2003 | Machado et al. | 439/607 |
| 2004/0014361 | A1 * | 1/2004 | Slack et al. | 439/620 |
| 2004/0014362 | A1 * | 1/2004 | Slack et al. | 439/620 |
| 2004/0161958 | A1 | 8/2004 | Togami et al. | |
| 2005/0036747 | A1 * | 2/2005 | Togami et al. | 385/92 |
| 2007/0224851 | A1 * | 9/2007 | Togami et al. | 439/76.1 |
| 2007/0224859 | A1 * | 9/2007 | Sasser et al. | 439/108 |
| 2007/0224884 | A1 * | 9/2007 | Engel et al. | 439/607 |
| 2007/0232091 | A1 * | 10/2007 | Hong | 439/66 |
| 2007/0237489 | A1 * | 10/2007 | Sasser et al. | 385/147 |

OTHER PUBLICATIONS

Sasser et al., Grounding Via a Pivot Lever in a Transceiver Module, U.S. Appl. No. 11/688,753, filed Mar. 20, 2007.

Sasser et al., Grounding a Printed Circuit Board in a Transceiver Module, U.S. Appl. No. 11/689,351, filed Mar. 21, 2007.

Togami et al., Electromagnetic Interference Containment in a Transceiver Module, U.S. Appl. No. 11/689,379, filed Mar. 21, 2007.

* cited by examiner

CONNECTOR STRUCTURE FOR A TRANSCEIVER MODULE

CROSS-REFERENCE TO RELATED APPLICATIONS

This application claims priority to U.S. Provisional Patent Application Ser. No. 60/785,162, filed on Mar. 23, 2006, which is incorporated herein by reference in its entirety.

BACKGROUND OF THE INVENTION

1. The Field of the Invention

The present invention relates generally to transceiver modules. More particularly, embodiments of the invention relate to a connector structure for containing various electronic components in a copper transceiver module.

2. The Related Technology

Small Form-factor Pluggable (SFP) transceiver modules are relatively small, hot-swappable devices that can be plugged into a variety of host networking equipment. The portions of fiber-optic SFP transceiver modules and copper SFP transceiver modules that are configured to be received inside a host port (the "host port portions") both conform to the SFP Transceiver Multi-Source Agreement (MSA), which specifies, among other things, package dimensions for the host port portions of such transceiver modules. Specifically, the Appendix A.A1 of the SFP Transceiver MSA, which is incorporated herein by reference in its entirety, specifies package dimensions for the SFP transceiver modules described therein. The conformity of the host port portions of the copper and optical SFP transceiver modules with respect to package dimensions and host interface configurations allows an optical SFP transceiver module to be replaced by a copper SFP transceiver module without the host networking equipment becoming aware of any change in the type of replacement. This interchangeability between copper and optical SFP transceiver modules allows for flexibility in a communications network that includes both copper and optical cabling.

The dimensional conformity required by the SFP Transceiver MSA creates some limitations, however, for copper SFP transceiver module design. Specifically, dimensional conformity of the host port portion required by the SFP Transceiver MSA defines a finite volume within which components of the SFP transceiver module can be located. Among the components included in the host port portion of a typical copper SFP transceiver module are one or more printed circuit boards and multiple electrical cores. The printed circuit boards generally include various electronic circuitry and components that provide functionality to the copper SFP transceiver module. To the extent that relatively more space can be made available on the printed circuit boards, relatively more electronic circuitry and components and functionality can be included within the copper SFP transceiver module.

In addition, copper SFP transceiver module designs are continually being modified to enable transceiver operation within ever-larger temperature ranges. In response, the electrical cores employed within the copper SFP transceiver modules have correspondingly increased in size. For example, the relative size of electrical cores in a copper SFP transceiver designed to operate within a −40° C. to 85° C. case temperature range is larger than those included in a transceiver designed to operate with a range from 0° C. to 70° C. Consequently, where more of the available space within a copper SFP transceiver module is being utilized by larger electrical cores, less space remains available for the inclusion of desirable electronic components on the printed circuit boards.

In light of the above discussion, a need currently exists for a transceiver module that efficiently utilizes the available space within the transceiver module. In particular, there is a need for a transceiver module that efficiently positions electrical cores within the transceiver module so as to preserve space for the inclusion of desirable electronic components on the printed circuit board(s) within the transceiver module.

BRIEF SUMMARY OF SOME EXAMPLE EMBODIMENTS

In general, embodiments of the invention are concerned with a transceiver module, such as a copper transceiver module, that utilizes an example connector structure for receiving the plug of a communication cable. The example connector structure is configured to house a plurality of electronic components in such a way as to efficiently utilize the space within the connector structure itself, thereby making additional space available on one or more printed circuit boards positioned within the copper transceiver module. The additional space made available on the printed circuit board(s) can then be utilized for the inclusion of additional electronic components, thereby enhancing transceiver performance and/or flexibility.

In one example embodiment, a connector structure for use in a copper transceiver module includes a body, a first plurality of conductive elements attached to the body, and first and second cavities defined in the body. The first plurality of conductive elements is configured to electrically connect with a corresponding second plurality of electrical elements on a plug of a communications cable. A first plurality of electrical cores and a printed circuit board are positioned in the first cavity. A second plurality of electrical cores is positioned in the second cavity.

In another example embodiment, a connector structure for use in a copper transceiver module includes a body and first and second cavities defined in the body. A first plurality of electrical cores and a printed circuit board are positioned in the first cavity. A second plurality of electrical cores is positioned in the second cavity. The connector structure also includes a first plurality of conductive elements and a second plurality of conductive elements attached to the body. The first plurality of conductive elements is electrically coupled through the printed circuit board to the second plurality of conductive elements.

In yet another example embodiment, a transceiver module for use in a communications network includes a housing, a base at least partially positioned within the housing, and a connector structure. The base includes a connector portion that is configured to remain substantially outside of a host port when the transceiver module is positioned within the host port. The connector structure includes a body, a first plurality of conductive elements attached to the body, a first cavity defined in a first portion of the body, a first plurality of electrical cores positioned within the first cavity, and a printed circuit board positioned within the first cavity. The first plurality of conductive elements is configured to electrically connect with a corresponding second plurality of electrical elements on a plug of a communications cable. The first portion of the connector structure is substantially positioned within the connector portion of the base.

These and other aspects of example embodiments of the present invention will become more fully apparent from the following description and appended claims.

BRIEF DESCRIPTION OF THE DRAWINGS

To further clarify aspects of the present invention, a more particular description of the invention will be rendered by reference to specific embodiments thereof which are disclosed in the appended drawings. It is appreciated that these drawings depict only example embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Example embodiments of the present invention relate to a transceiver module, such as a copper transceiver module, that utilizes an example connector structure for receiving the plug of a communication cable. The example connector structure is configured to house a plurality of electronic components in such a way as to efficiently utilize the space within the connector structure itself, thereby making additional space available on one or more printed circuit boards positioned within the copper transceiver module. The additional space made available on the printed circuit board(s) can then be utilized for the inclusion of additional electronic components, thereby enhancing transceiver performance and/or flexibility.

While described in the context of copper transceiver modules used in the field of communications networking, it will be appreciated that example embodiments of the present invention are applicable to other applications as well. For example, other types of transceiver modules, both electronic and opto-electronic, could utilize embodiments of the example connector structure disclosed herein in order to utilize space more efficiently within the transceiver modules.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

In the following description, numerous specific details are set forth in order to provide a thorough understanding of example embodiments of the present invention. It will be obvious, however, to one skilled in the art that the example embodiments of the present invention may be practiced without these specific details. In other instances, well-known aspects of transceiver modules have not been described in great detail in order to avoid unnecessarily obscuring the example embodiments of the present invention.

I. Example Transceiver Module

Figure 1:
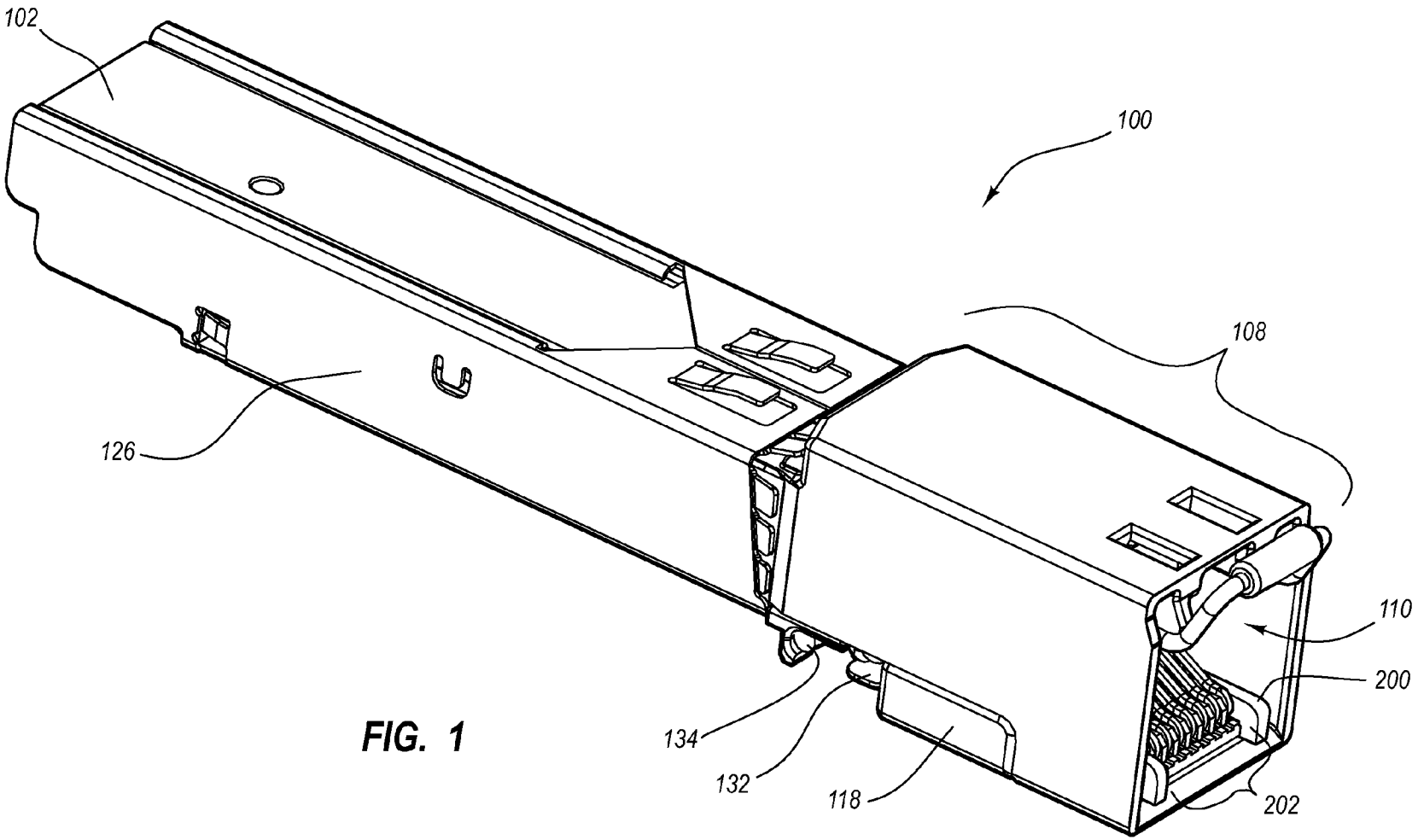
FIG. 1 is a perspective view of one example embodiment of an assembled copper transceiver.
Figure 2:
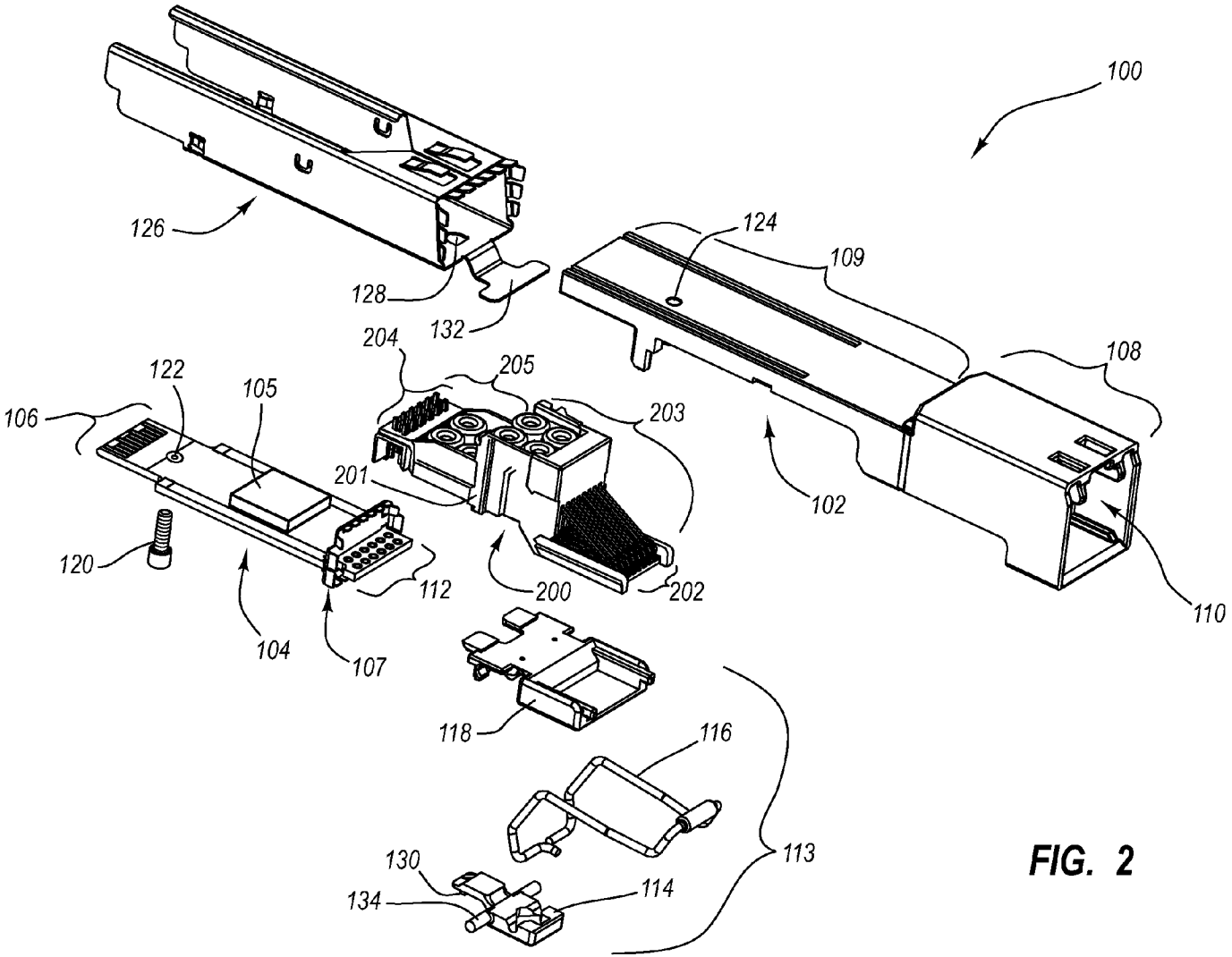
FIG. 2 is an exploded perspective view of the copper transceiver module of FIG. 1 including an example connector structure.

Reference is first made to FIGS. 1 and 2 together, which disclose perspective views of one example embodiment of a copper transceiver module, designated generally at 100. The transceiver module 100 has a low profile. Further, a portion of the transceiver module 100 that is configured to be positioned within a host port (not shown) substantially complies with existing industry standards, including transceiver module form factor, specified in the Small Form-factor Pluggable (SFP) Transceiver MultiSource Agreement (MSA). The transceiver module 100 achieves data rates of 1.25 Gb/s, supports the 1000Base-T transmission standard (also known as the IEEE 802.3ab standard), operates between about −40° C. and about 85° C., and is pluggable. Aspects of example embodiments of the present invention can be implemented in transceiver modules having other data rates, transmission standards, and/or operating temperatures. Likewise, aspects of example embodiments of the present invention can be implemented in transceiver or other communication modules that are not pluggable.

In the disclosed example, the transceiver module 100 includes an elongated base, designated generally at 102, that is configured to support and retain a first printed circuit board 104. In this example, the printed circuit board 104 accommodates various electronic components 105 positioned thereon, and it can include differing components and circuitry configurations, depending on the type of transceiver module in which it is implemented. Also formed on the printed circuit board 104 at a rear end is an exposed edge connector 106. The edge connector 106 is configured to be electrically compatible with a corresponding electrical connector (not shown) that is positioned within the port of a host device (not shown). Other connector schemes that are well known in the art could also be used in the transceiver module 100. In addition, as disclosed in FIG. 2, the transceiver module 100 includes an EMI shield 107 that is configured so as to circumscribe a portion of the printed circuit board 104.

In the disclosed example embodiment, the base 102 can generally be divided into a connector portion, designated generally at 108, and a host port portion, designated generally at 109. The connector portion 108 is positioned at one end of the base 102 of the transceiver module 100. The connector portion 108 of the base 102 is generally the portion of the transceiver module 100 that remains on the outside of a host device (not shown) when the host port portion 109 of the base 102 and the housing 126 are operably positioned within a port of the host device (not shown). The connector portion 108 also defines an RJ-45 jack 110 that is configured to operatively receive a corresponding RJ-45 plug (not shown) of a typical copper communications cable. Other examples of jack and plug configurations include, but are not limited to, jacks and plugs compliant with registered jack ("RJ") standards such as RJ-11, RJ-14, RJ-25, RJ-48, and RJ-61 standards. The RJ-45 standard is commonly used in conjunction with copper communications cables. Examples of copper communications cables include, but are not limited to, Category 5 ("CAT-5") cables, CAT-5e cables, and CAT-6 cables. It will be appreciated that the jack 110 could be implemented to accommodate any one of a number of different connector configurations, depending on the particular application involved.

The transceiver module 100 further includes a connector structure 200. The connector structure 200 generally includes a body 201 having a first portion 203 and a second portion 205. In one example embodiment, the body 201 is a monolithic plastic component, although multi-piece non-plastic bodies are also possible. The first portion 203 of the connector structure 200 generally fits within the connector portion 108 of the base 102. The second portion 205 of the connector structure 200 generally fits within the host port portion 109 of the base 102. The connector structure 200 further includes a first plurality of conductive elements 202 attached to the body 201 that are configured to electrically connect with a corresponding plurality of electrical elements on an RJ-45 plug (not shown) when the RJ-45 plug is inserted into the RJ-45 jack 110. The connector structure 200 also includes a second plurality of conductive elements 204 attached to the body 201 that are configured to electrically connect with a corresponding plurality of plated through holes 112 on the printed circuit board 104.

The transceiver module 100 also includes a latch mechanism 113, which is made up of a pivot block 114, a bail 116, and a mounting plate 118. In one example embodiment, the latch mechanism 113 provides several functions. First, the latch mechanism 113 provides a mechanism for "latching" the transceiver module 100 within a host port (not shown) when the transceiver module 100 is operatively received within the host port. Moreover, the latch mechanism 113 also provides a convenient means for extracting the transceiver module 100 from the host port, without the need for a special extraction tool. The latch mechanism 113 is preferably implemented so as to substantially preserve the small form factor of the transceiver module 100 in accordance with prevailing standards, and in a manner that allows convenient insertion and extraction of a single transceiver module from a host port without disturbing adjacent transceiver modules or adjacent copper communications cables—even when used in a host having a high port density. Also, in an example embodiment, the latch mechanism 113 precludes inadvertent extraction of the transceiver module 100 from the host port when an RJ-45 plug is operatively received within or removed from the RJ-45 jack 110.

The mounting plate 118 includes mounting and pivot components for use in operatively interconnecting the pivot block 114, the bail 116 and the transceiver module 100. The function of the pivot block 114 and the bail 116 with respect to the mounting plate 118 within the transceiver module 100 is substantially similar to the function and operation of a pivot block 310 and a bail 308 with respect to a mounting plate 314 within a module 300 as disclosed in connection with FIGS. 5 and 6 of U.S. Patent Application Publication No. "2004/0161958 A1" titled "Electronic Modules Having Integrated Lever-Activated Latching Mechanisms," published Aug. 19, 2004, which is incorporated herein by reference in its entirety.

As disclosed in FIG. 2, after the connector structure 200 is operably connected to the printed circuit board 104 and operably assembled within the base 102, the mounting plate 118 partially encloses the connector structure 200 within the connector portion 108 of the base 102. The mounting plate 118 is made from an electrically conductive material, as is the base 102. Therefore, after the assembly of the transceiver module 100, when the base 102 is grounded, for example to chassis ground through the housing 126, the mounting plate 118 is also necessarily grounded because of the secure electrical attachment of the mounting plate 118 to the connector portion 108 of the base 102. The printed circuit board 104 is also secured to the base 102 with a fastener 120 which passes through an opening 122 in the printed circuit board 104 and into an opening 124 in the base 102.

FIGS. 1 and 2 disclose how the base 102 and the printed circuit board 104 are at least partially enclosed and retained within a housing, designated generally at 126. The housing 126 is generally rectangular in cross-sectional shape so as to accommodate the base 102. The housing 126 includes an opening at its rear end so as to expose the edge connector 106 and thereby permit it to be operatively received within a corresponding electrical connector slot (not shown) within a host port of a host device (not shown). In one example embodiment, the housing 126 is formed of a conductive material such as sheet metal.

In an example embodiment, the housing 126 is configured so as to accommodate the latch mechanism 113 of the transceiver module 100. For example, a bottom surface of the housing 126 includes a locking recess 128, which is sized and shaped to expose a lock pin 130 of the pivot block 114 when the latch mechanism 113 is assembled within the transceiver module 100 and is in a latched position. Also, the housing 126 includes a means for biasing the latch mechanism 113 to a latched position. By way of example, in one example embodiment, the biasing means can be a resilient metal portion of the housing that is formed as a leaf spring 132. When the transceiver module 100 is operably assembled, the leaf spring 132 can be biased against a top surface of the pivot block 114 so as to operatively secure the pivot block 114 in its assembled position. Also, the biasing action can be applied so as to urge the pivot block 114 in a rotational direction about a pivot point 134 so as to expose the lock pin 130 through the locking recess 128, which corresponds to the transceiver module 100 being in a latched position.

II. Example Connector Structure

Figure 3:
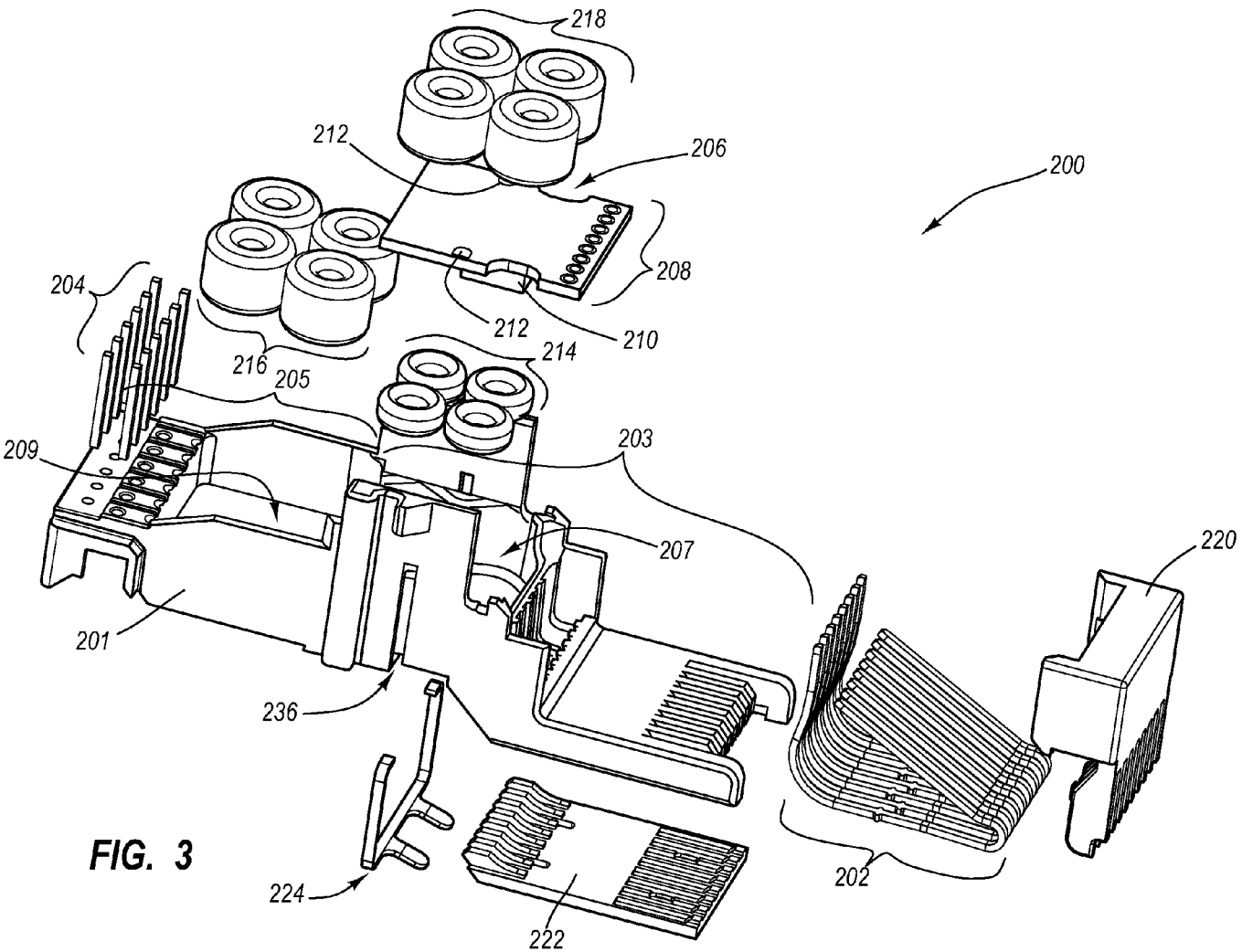
FIG. 3 is an exploded perspective view of the connector structure of FIG. 2.
Figure 4:
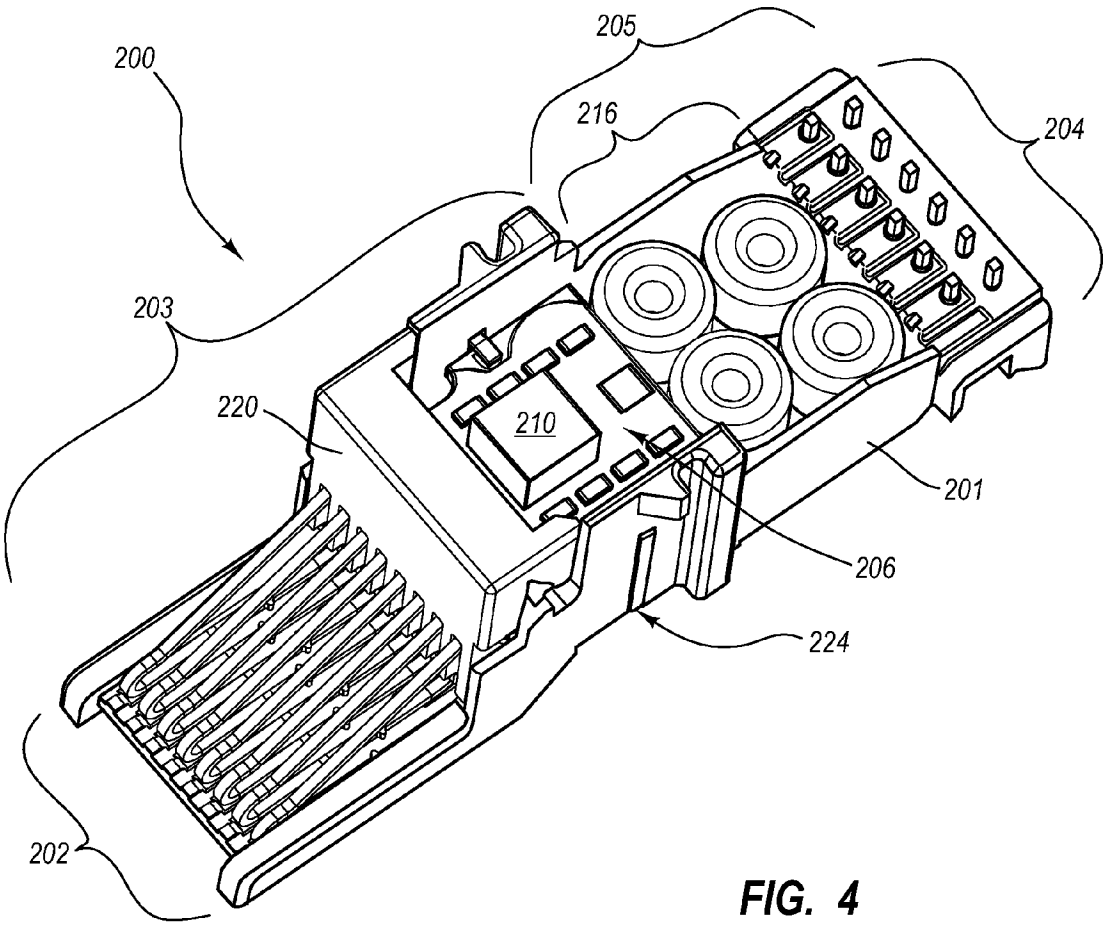
FIG. 4 is an assembled perspective view of the top side of the connector structure of FIGS. 2 and 3.

Reference is now made to FIGS. 3 and 4 together, which disclose perspective views of the example connector structure 200 of FIG. 2. FIG. 3 is an exploded perspective view of the connector structure 200 and FIG. 4 is an assembled perspective view of the connector structure 200. As disclosed previously, the connector structure 200 includes a first plurality of conductive elements 202 and a second plurality of conductive elements 204 attached to the body 201. The connector structure 200 also includes a printed circuit board 206 that is sized and configured to be positioned within a first cavity 207 formed in the first portion 203 of the body 201 of the connector structure 200. The printed circuit board 206 includes a plurality of plated through holes 208 that correspond to the first plurality of conductive elements 202. When the connector structure 200 is operably assembled, each of the conductive elements 202 is received by a respective one of the plated through holes 208 such that an electrical connection between the conductive elements 202 and the plated through holes 208 is achieved. The printed circuit board 206 also includes electronic circuitry 210 and ground contacts 212.

As disclosed previously, the conductive elements 204 are configured in the example embodiment as pins that engage the corresponding plated through holes 112 of the printed circuit board 104. The conductive elements 202 and 204, together with their corresponding plated through holes 208 and 112, respectively, define a portion of a plurality of conductive pathways that electrically couple the jack 110, where a communications cable plug is received, to a host device within which the transceiver module 100 is received.

The connector structure 200 also includes electrical cores 214, 216, and 218. In one example embodiment, the connector structure 200 is configured to accommodate either eight electrical cores or twelve electrical cores. When the connector structure 200 includes only eight electrical cores, as shown in FIG. 4, the electrical cores 214 are positioned in the first cavity 207, and the electrical cores 216 are positioned in a second cavity 209 defined in the second portion 205, while the printed circuit board 206 is positioned on top of the electrical cores 214 such that the side of the printed circuit board 206 that includes the electronic circuitry 210 is facing up (the "eight-core position"). When the connector structure 200 includes twelve electrical cores, as shown in FIG. 3, the electrical cores 214 and the electrical cores 218 are positioned in the first cavity 207, and the electrical cores 216 are positioned in a second cavity 209, while the printed circuit board 206 is flipped over and positioned between the electrical cores 214 and the electrical cores 218 such that the electronic circuitry 210 is facing down (the "twelve-core position").

The plated through holes 208 and the ground contacts 212 of the printed circuit board 206 are designed to accommodate the printed circuit board 206 being positioned in either the eight-core position or the twelve-core position. In particular, the plated through holes 208 extend through the printed circuit board 206. The ground contacts 212 also extend through the printed circuit board 206 such that the ground contacts 212 can be accessed on either side of the printed circuit board 206. The ability the printed circuit board 206 to be positioned in either the eight-core position or the twelve-core position allows for more effective use of the space within the connector structure 200. Specifically, this multi-positioning ability of the printed circuit board 206 allows for the electrical cores 218 to be stacked above the electrical cores 214 in the connector structure 200 when the connector structure 200 includes twelve electrical cores.

The connector structure 200 also includes mounting brackets 220 and 222, which secure the conductive elements 202 to the connector structure 200. The mounting brackets 220 and 222 are also designed to properly align the conductive elements 202 for electrical connection with corresponding conductive elements of an RJ-45 plug (not shown) when the RJ-45 plug is inserted into the RJ-45 jack 110 of the transceiver module 100, as disclosed in FIGS. 1 and 2. In accordance with one example embodiment of the invention, the connector structure 200 also includes a ground clip 224. The ground clip 224 substantially prevents the printed circuit board 206 from vertical and horizontal displacement from its intended position within the body 201 of the connector structure 200. The ground clip 224 also serves to electrically ground portions of the printed circuit board 206 to chassis ground. Additional details regarding the structure and function of the ground clip 224 can be found in co-pending U.S. patent application Ser. No. 11/689,351, titled "GROUNDING A PRINTED CIRCUIT BOARD IN A TRANSCEIVER MODULE," which was filed on Mar. 21, 2007, and is incorporated herein by reference in its entirety.

The connector structure 200 and the base 102 make effective use of the finite volume of space in the host port portion 109 allowed by the SFP Transceiver MSA package dimension constraints. Specifically, the body 201 of the connector structure 200 and the base 102 are shaped such that the electrical cores 214 and 218 can all be housed within the first portion 203 of the connector structure 200, which in turn is housed within the connector portion 108 of the base 102. This negates the need, for example, to locate some or all of the electrical cores 214, 216, and 218 on the printed circuit board 104, which in turn provides relatively more space on the printed circuit board 104 for the placement of other electronic components.

This relative increase in usable volume within the transceiver module 100 is made possible in part because of the efficient use of space by the latch mechanism 113. Other latch mechanisms designs implemented in other copper SFP transceiver modules can cause the conductive elements of the RJ-45 jack of an SFP transceiver module to sit higher within the RJ-45 jack, which results in less space to stack electrical cores in the connector structure of the SFP transceiver module. More particularly, in copper SFP transceiver modules designed to operate in temperature ranges from about −40° C. to about 85° C., which necessitates larger electrical cores than, for example, copper SFP transceiver modules designed to operate in temperature ranges from about 0° C. to about 70° C., the body 201 of the connector structure 200 and the base 102 are sized and configured to allow up to eight electrical cores to be positioned within the connector portion 108 of the base 102. As disclosed previously, this positioning of up to eight electrical cores in the connector portion 108 of the base 102 can allow for more available space, for example, for electronic components on the one or more printed circuit boards within the copper SFP transceiver module 100. For example, the efficient use of available space in the transceiver module 100 can allow for additional electronic components, such as additional jump resistors, which in turn allows for additional features and configuration options. This in turn enhances the electrical robustness of the transceiver module 100 and provides for improved electrical characteristics thereof The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A connector structure for use in a transceiver module, the connector structure comprising:

a body;

a first plurality of conductive elements attached to the body, the first plurality of conductive elements configured to electrically connect with a corresponding second plurality of electrical elements on a plug of a communications cable;

a first cavity defined in the body;

a first plurality of electrical cores positioned in the first cavity;

a second cavity defined in the body;

a second plurality of electrical cores positioned in the second cavity; and a printed circuit board positioned within the first cavity.

2. The connector structure as recited in claim 1, wherein the first plurality of electrical cores comprises four electrical cores.

3. The connector structure as recited in claim 1, wherein the second plurality of electrical cores comprises four electrical cores.

4. The connector structure as recited in claim 1, wherein the first plurality of electrical cores comprises eight electrical cores.

5. The connector structure as recited in claim 4, wherein at least a portion of the printed circuit board is positioned between at least two of the eight electrical cores.

6. A connector structure for use in a transceiver module, the connector structure comprising:

a body;

a first plurality of conductive elements attached to the body;

a second plurality of conductive elements attached to the body;

a first cavity defined in the body;

a first plurality of electrical cores positioned in the first cavity;

a second cavity defined in the body;

a second plurality of electrical cores positioned in the second cavity; and a printed circuit board positioned within the first cavity, wherein the first plurality of conductive elements is electrically coupled through the printed circuit board to the second plurality of conductive elements.

7. The connector structure as recited in claim 6, wherein the first plurality of conductive elements are configured to electrically connect with corresponding electrical elements of an RJ-45 plug.

8. The connector structure as recited in claim 6, wherein the second plurality of conductive elements are configured to electrically connect with corresponding electrical elements of a second printed circuit board.

9. The connector structure as recited in claim 6, wherein the first plurality of electrical cores comprises eight electrical cores.

10. The connector structure as recited in claim 9, wherein at least a portion of the printed circuit board is positioned between at least two of the eight electrical cores.

11. A transceiver module for use in a communications network, the transceiver module comprising:

a housing;

a base at least partially positioned within the housing; the base including a connector portion that is configured to remain substantially outside of a host port when the transceiver module is positioned within the host port; and a connector structure, the connector structure comprising:

a body;

a first plurality of conductive elements attached to the body, the first plurality of conductive elements configured to electrically connect with a corresponding second plurality of electrical elements on a plug of a communications cable;

a first cavity defined in a first portion of the body, the first portion substantially positioned within the connector portion of the base;

a first plurality of electrical cores positioned within the first cavity; and a printed circuit board positioned within the first cavity.

12. The transceiver module as recited in claim 11, wherein a portion of the transceiver module that is configured to be positioned within a host port substantially conforms to the SFP Transceiver MSA.

13. The transceiver module as recited in claim 11, wherein the transceiver module is configured to achieve data rates of about 1.25 Gb/s.

14. The transceiver module as recited in claim 11, wherein the transceiver module substantially supports the 1000Base-T transmission standard.

15. The transceiver module as recited in claim 11, wherein the transceiver module is configured to operate between about −40° C. and 85° C.

16. The transceiver module as recited in claim 11, wherein the first plurality of electrical cores comprises four electrical cores.

17. The transceiver module as recited in claim 11, wherein the first plurality of electrical cores comprises eight electrical cores.

18. The transceiver module as recited in claim 17, wherein at least a portion of the printed circuit board is positioned between at least two of the eight electrical cores.

19. The transceiver module as recited in claim 11, wherein the connector structure further comprises:

a second cavity defined in a second portion of the body, the second portion substantially positioned within the base; and a second plurality of electrical cores positioned within the second cavity.

20. The transceiver module as recited in claim 19, wherein the second plurality of electrical cores comprises four electrical cores.

* * * * *